United States Patent [19]

Gillette et al.

[11] 4,325,982

[45] Apr. 20, 1982

[54] ZIPPER CHAIN COATER

[75] Inventors: Donald J. Gillette, Guilford; Bedrich Hajek, New Haven; David Seales, East Haven, all of Conn.

[73] Assignee: Electrostatic Equipment Corporation, New Haven, Conn.

[21] Appl. No.: 143,115

[22] Filed: Apr. 23, 1980

[51] Int. Cl.[3] ..... B05D 1/04; B05D 1/28

[52] U.S. Cl. ..... 427/32; 118/621; 118/623; 118/624; 427/25; 427/27; 427/46; 427/195

[58] Field of Search ..... 427/25, 27, 132.46, 427/194, 195, 286, 375, 374.9, 428; 118/621, 623, 624, 305

[56] References Cited

U.S. PATENT DOCUMENTS

| | | | |
|---|---|---|---|
| 2,079,563 | 5/1937 | Reuter | 427/428 |
| 2,820,716 | 1/1958 | Harman et al. | 427/25 |
| 3,019,126 | 1/1962 | Bartholomew | 427/32 X |
| 3,197,324 | 7/1965 | Brooks | 427/185 |
| 3,756,852 | 9/1973 | Scheetz et al. | 427/185 X |
| 3,787,222 | 1/1974 | Duffy | 427/195 |
| 3,958,039 | 5/1976 | Yabuki et al. | 427/194 X |
| 3,979,529 | 9/1976 | Rebentisch et al. | 118/624 X |
| 4,060,648 | 11/1977 | Taylor-Brown | 427/32 |
| 4,101,687 | 7/1978 | Knudsen | 427/25 |
| 4,244,985 | 1/1981 | Graff et al. | 427/46 |

*Primary Examiner*—Shrive P. Beck

[57] ABSTRACT

Zipper chain is continuously electrostatically coated with powder to produce good coverage of the teeth, even upon its more obscured surfaces. The web is substantially uncoated, and is protected against deleterious heat effects.

18 Claims, 5 Drawing Figures

ZIPPER CHAIN COATER

BACKGROUND OF THE INVENTION

In the course of manufacturing zippers, it is common practice to coat them with a variety of materials and for a number of reasons, such as to color or otherwise improve or modify their appearance, to afford protection against corrosion or the like, and to facilitate operation, e.g., by providing low-friction surfaces thereon. Conventionally, the coatings are produced by applying the material as a liquid; however, such an approach is often difficult, disadvantageous, or unfeasible. Thus, it is difficult to limit the coating to those areas on which it is desired (i.e., the teeth but not the fabric) while at the same time producing adequate coverage, especially on obscured surfaces lying between the teeth. In other cases, the coating material may not be suitable for application in liquid form, either because it does not readily dissolve or melt, or because the solvent or heat involved would have a deleterious effect upon the zipper. For example, when the fabric web is made from a heat-sensitive material, it may not be feasible to apply the coating as a melt, depending, of course, upon the temperatures involved. Similarly, a technique in which the deposited material requires post-heating may not be feasible when the web material is incapable of withstanding the elevated temperatures to which it would normally be subjected.

Accordingly, it is a primary object of the present invention to provide a novel method and apparatus for continuously coating a zipper chain with a heat-fusible particulate coating material.

It is also an object of the invention to provide such a method and apparatus whereby the coating may be produced on a zipper chain which includes a web made from a fabric that is adversely affected by exposure to elevated temperatures.

Another object is to provide such a method and apparatus whereby the coating is produced uniformly upon substantially all exposed surfaces of the teeth of the zipper.

Still another object of the invention is to provide such a method and apparatus which are adapted for the high speed production of coatings efficiently, conveniently, and relatively inexpensively.

SUMMARY OF THE DISCLOSURE

It has now been found that certain of the foregoing and related objects of the invention are readily attained in a method for continuously producing smooth, adherent coatings upon the teeth of a zipper chain, in which method a zipper chain, comprised of a fabric web having a multiplicity of metal teeth affixed thereto, is continuously moved along a travel path. Particles of a heat fusible powder are deposited upon the moving chain in areas substantially limited to the surfaces of the teeth, and the chain is heated only in such limited areas, to effect fusion and initial cohesion of the deposited particles. Thereafter, inadequately adhered particles are removed from the moving chain, and the "limited areas" thereof are heated to effect final cohesion of the particles and to produce, upon cooling of the chain, a smooth, adherent coating thereof on the teeth.

Preferably, the particles of powder will be electrostatically charged, with the deposit being produced by electrostatic attraction of the particles to the teeth surfaces. Using such a technique, the particles are most desirably mechanically carried into close proximity to the teeth, with the conditions being such that the attractive force of the teeth upon the particles will be greater than that of the means carrying them, whereby transfer from the carrying means to the teeth is effected electrostatically. Ideally, the carrying means for the powder includes a member having a surface that is configured not only to maximize the quantity of powder presented to the teeth, but also to minimize the quantity thereof presented to the fabric web.

In especially preferred embodiments of the method, heating of the chain will be produced by electromagnetic induction so as to substantially limit the heat generated to a surface effect. The electromagnetic flux pattern will, of course, desirably be configured to promote optimal heating of the teeth, and reheating will generally be produced in the same manner as the initial heating effect. The inadequately adhered particles can be removed effectively by brushing between the teeth of the zipper chain, in a direction generally parallel to the longitudinal axes thereof.

Other objects of the invention are attained in apparatus comprising a base, means for continuously conveying a zipper chain along a travel path thereacross, and means for depositing particles of a heat fusible powder upon the zipper chain as it moves along the travel path, with the depositing means being effective to deposit powder in areas substantially limited to the surface of the teeth. Means is also included for heating the chain as it moves along the travel path to effect fusion and cohesion of the deposited particles, which heating means is effective to heat the chain substantially only in the "limited areas" coated with powder. Downstream of the initial heating means is means for removing inadequately adhered particles from the zipper chain, and means for reheating the "limited" areas of the zipper chain, as it moves further along the travel path, is provided to effect final cohesion of the particles and to produce, upon cooling of the chain, a smooth, adherent coating on the teeth.

In preferred embodiments of the apparatus, the depositing means will effect electrostatic charging of the particles, so that the deposit will be produced by electrostatic attraction of the particles to the teeth surfaces. In such apparatus, the depositing means will most desirably include means for mechanically carrying the charged particles into close proximity to the teeth so that electrostatic transfer can be effected. Such carrying means beneficially comprises a pair of rotatable wheels, one of which is disposed on each side of the travel path to effectively present the powder to the chain, thereby permitting simultaneous coating of both sides. Ideally, such apparatus will additionally include electrostatic fluidized bed means, with the wheels being disposed to rotate therethrough, enabling deposits of the powder to be produced thereon. Since the zipper chain will generally move horizontally along the travel path, with a vertical orientation, such transfer wheels will normally be disposed at an angle of substantially 45° with respect thereto, and will have an edge bevel of substantially 45°, thereby permitting close proximity to the surfaces of the zipper chain. For most effective coating, the wheel edges may be grooved to permit partial enclosure thereby of the teeth of the zipper chain. The circumferential edges of the wheels may be electrically insulated to reduce attraction of the charged particles, thereby ensuring effective transfer from the wheels to the chain.

In the apparatus, the heating means is desirably an electromagnetic induction heater, which preferably will include elements dimensioned and configured to produce an electromagnetic flux pattern that is configured to promote optimal heating of the teeth. Specifically, such elements may comprise a pair of opposing, C-shaped heads within the coil of the heater, with the heads being dimensioned and configured to substantially surround the teeth as the chain passes therebetween. The apparatus may additionally include a second induction heater located downstream of the first-mentioned heater, for the purpose of reheating the chain, and the removing means may include a brush operative to brush between the teeth in a direction generally parallel to their longitudinal axes, with the brush being disposed between the first and second-mentioned heaters.

DETAILED DESCRIPTION OF THE ILLUSTRATED EMBODIMENT

Figure 4:
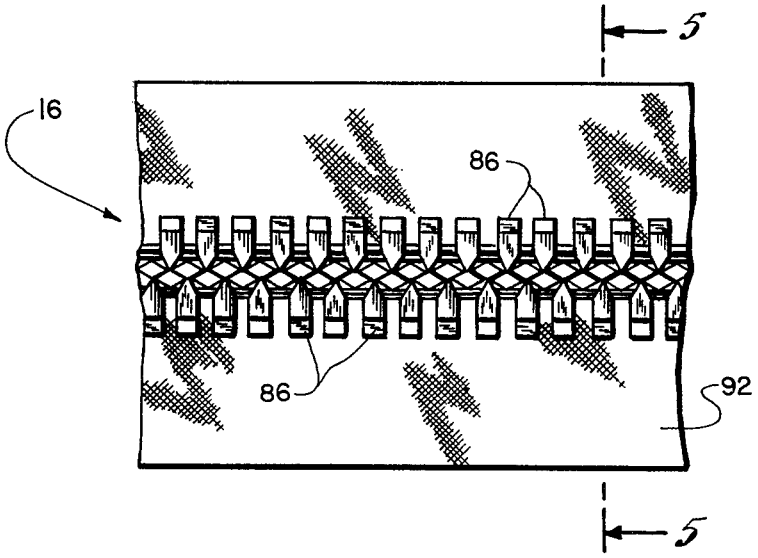
FIG. 4 is a plan view of a typical zipper chain coated using the present system.
Figure 5:
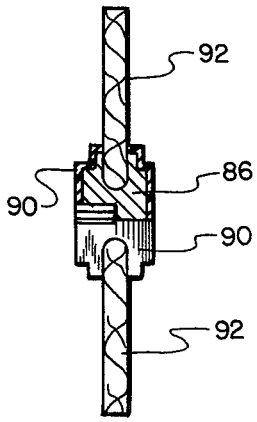
FIG. 5 is a cross-sectional view of the zipper chain of FIG. 4, taken along line 5—5 thereof.

The zipper chain for which the present invention is used is of conventional construction, and comprises parallel strips of a fabric web to the inside edges of which are affixed a multiplicity of metal teeth. FIGS. 4 and 5 of the appended drawings are illustrative, and will be discussed more fully hereinbelow.

Figure 1:
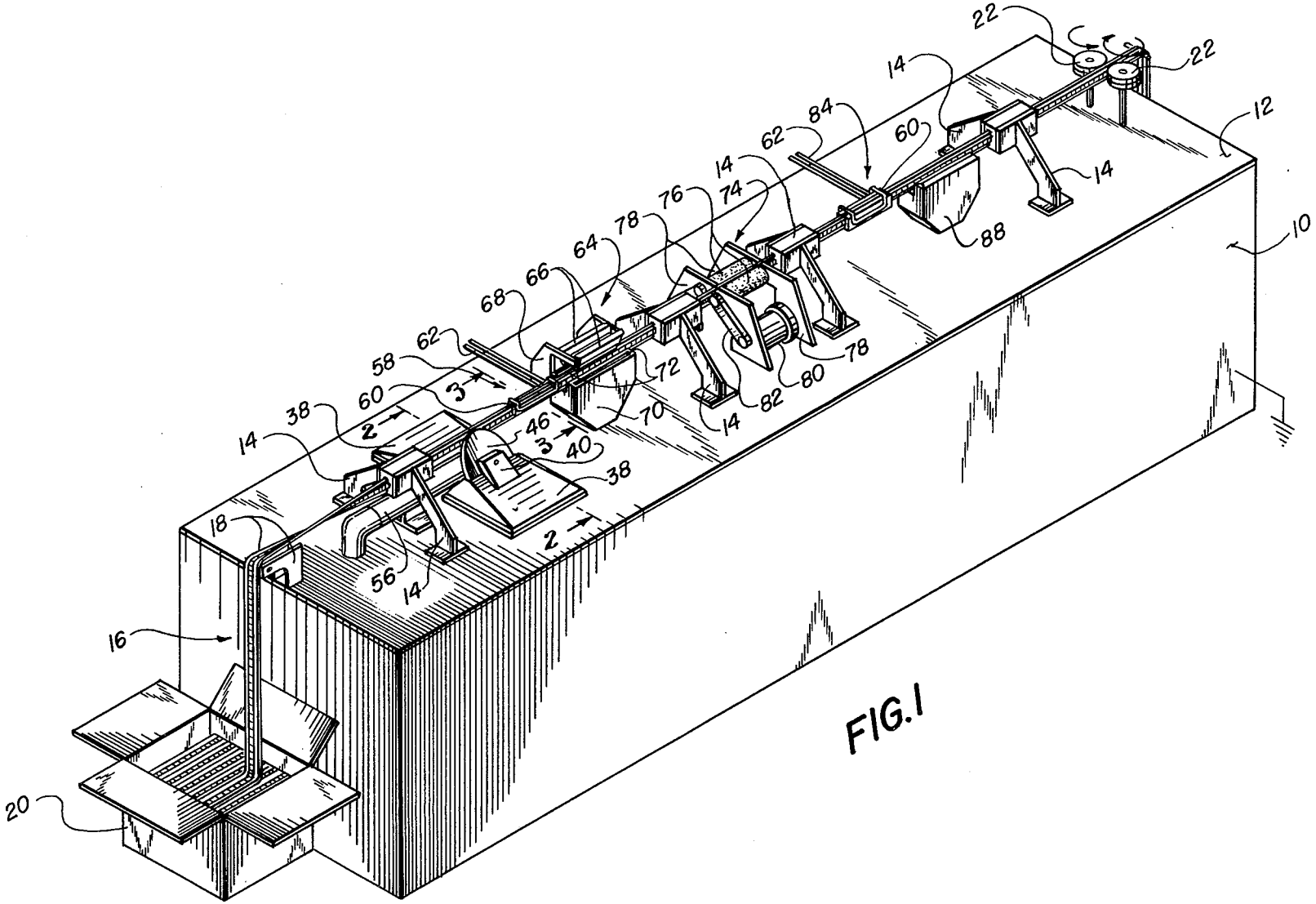
FIG. 1 is a perspective view of a system embodying the present invention, shown in operation with a zipper chain traveling therethrough.

Turning now, however, to FIG. 1 of the drawings, therein illustrated is an electrostatic coating system embodying the present invention and specifically adapted for coating the zipper chains, generally designated by the numeral 16. The system consists of a base 10 having an upper surface or table 12, on which are mounted four zipper chain guides 14. Each of the guides 14 has an opening therethrough configured to support and properly orient the zipper chain 16, as it passes across the table 14 and through the system. Mounted at one end of the table 12 is a roller guide 18, and a pair of drive wheels 22 are mounted thereon at its other end. As will be apparent, the wheels 22 are rotated countercurrently with the zipper chain 16 engaged therebetween, causing the chain to be pulled from its supply box 20, over and through the guides 18, 14, and past the several stations of the system.

Figure 2:
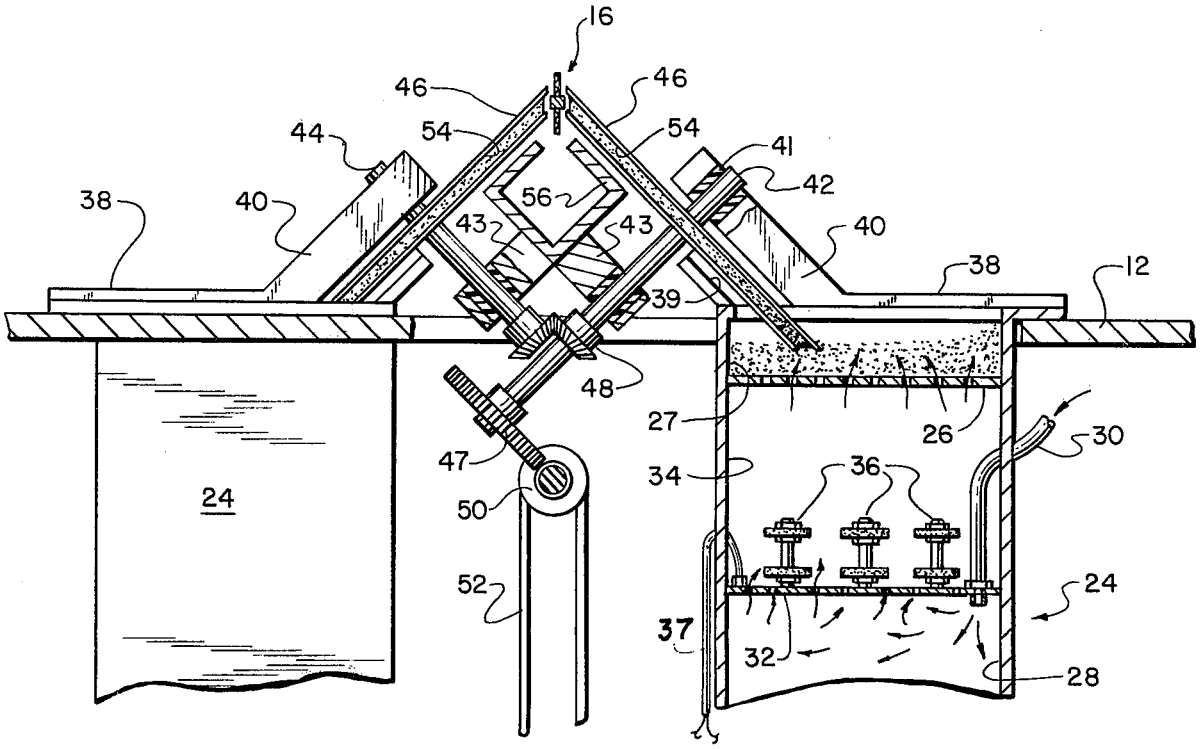
FIG. 2 is a fragmentary cross-sectional view of the system of FIG. 1, taken along line 2—2 thereof and drawn to an enlarged scale, with a portion of the system being broken away to illustrate the construction of one of the electrostatic fluidized coating units employed therein.

The first operation performed on the chain 16 occurs at the coating station, which is comprised of two electrostatic units, the details of which can be seen most readily in FIG. 2. Specifically, disposed to opposite sides of the travel path of the zipper chain 16 are two substantially identical, electrostatic coating chambers, generally designated by the numeral 24. The chambers are constructed in accord with the disclosure of Karr U.S. Pat. No. 4,030,446, and so need not be described in great detail. Nevertheless, it might be pointed out that each unit 24 includes a porous plate 26, upon which the coating powder is deposited and below which ionized gas is generated. Air enters the lower plenum 28 through the conduit 30, and flows upwardly therefrom through the electrically conductive metal plate 32 and into the upper plenum 34. The plate 32 has mounted thereon a multiplicity of brush-like electrodes 36, which are charged to a high electrical potential by connection through cable 37 to a high voltage D.C. source (not illustrated). The air flowing from the lower plenum 28 into the upper plenum 34 is directed to pass into contact with the ends of the bristles of the brush electrodes 36, and is thereby ionized. Upon passage thereafter through the porous plate 26 and into the fluidization chamber 27 thereabove, the air fluidizes and electrically charges the particles contained therein.

Each of the electrostatic coating units is enclosed by a cover member 38, which is constructed with an elongated opening 39 and an adjacent bracket portion 40; the bracket portion 40 extends inwardly and upwardly at a 45° angle toward the travel path of the zipper chain, and it has a suitable bearing 41 secured within its outer end. The axels 42,44 are journalled between bearings 41 and bearing blocks 43; axel 42 has a pinion 47 fixed to its inner end, and a bevel gear 48 spaced upwardly from it. The pinion 47 is in meshing engagement with a worm gear 50, and the latter is driven through belt 52 from drive means (not shown). A mating bevel gear 54 is mounted on the inner end of the axel 44, causing both of the axels to be rotated at precisely the same speed when the worm gear 50 is driven. Disposed between the wheels 46 and aligned beneath the travel path of the zipper chain 16 is a slotted conduit 56, which is incorporated into a typical vacuum recovery system (not shown); the conduit 56 serves to recover excess or loose powder.

Mounted on the axels 42,44, and symmetrically positioned to either side of the travel path of the zipper chain 16, are transfer wheels 46, which serve to transfer the charged powder particles from the fluidized bed units to the zipper chain. Being electrically grounded, the wheels 46 become coated with the powder as they are rotated through the fluidization chambers 27. Because they are dimensioned to intersect the travel path, the wheels 46 carry the powder, deposited upon their circumferential edges 54, into close proximity to the zipper chain 16 as it passes therebetween, from which positions the powder transfers to the chain. It will be appreciated that the chain, like the transfer wheels, is grounded, and that the transfer of particles from the wheels is attributable to an electrical insulating effect. Thus, either because of inherent powder buildup on the wheels, or because they have intentionally been coated with an insulating material, the electrostatic attraction of the wheels to the charged particles is at a lower level than is that of the zipper chain; consequently, the particles jump when they are brought close enough to do so. It should also be appreciated that, although the edges 54 of the transfer wheels may be straight across, bevelled or otherwise configured, the grooved configuration illustrated is most advantageous. With such a profile, the powder will be presented to the top and bottom surfaces of the teeth of the zipper chain as well as to the sides thereof, thus promoting maximum coverage by the coating produced.

Figure 3:
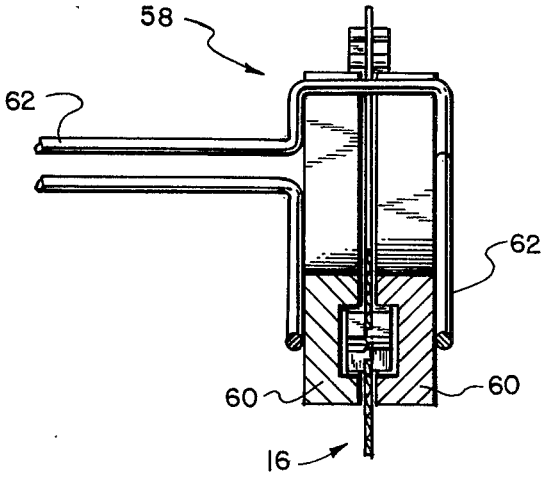
FIG. 3 is a fragmentary perspective view of one of the induction heating units of the system of FIG. 1, drawn to an enlarged scale and viewed downwardly from along line 3—3 thereof.

At the next station of the system is provided an induction heating unit, generally designated by the numeral 58, and consisting of a set of C-shaped heads 60, supported by and mounted within a coil 62, which in turn is connected to a high frequency oscillator (not shown). The relationship and configuration of the heads 60, which are illustrated in FIG. 3, provide an optimum heating pattern for effecting the fusion of the powder, by most effectively concentrating the magnetic flux produced in the coil 62 for that purpose.

After passing through the induction heating unit 58, the chain 16 is conveyed through an air-knife assembly, generally designated by the numeral 64; the assembly 64 consists of a pair of elongated nozzles 66, supported by brackets 68 above and to opposite sides of the travel path of the chain. A dust collector head 70, mounted below the travel path, has elongated slot-like openings 72, which are disposed to either side of the zipper chain and are aligned with it and with a corresponding one of the nozzles 66. As will be appreciated, air under pressure is introduced into the body of the nozzles 66 (by means and from a source not shown), to issue as a high velocity "sheet." Any inadequately fused particles of powder present on the zipper chain 16 will be dislodged thereby, and removed through the head 72 by an appropriate vacuum system.

The thus precleaned chain then proceeds through the support 14 and into a brush cleaning station, generally designated by the numeral 74. This station consists of a symmetrical arrangement of two counter-rotating cylindrical brushes 76, which are mounted on opposite sides of the travel path, with their axes parallel thereto. Each brush 76 is journalled between a pair of brackets 78, which also mount a small electric motor 80 to which the brush 76 is coupled by a drive belt 82. The two brushes 76 operate simultaneously upon opposite sides of the zipper chain 16, with their bristles moving downwardly thereacross, thereby dislodging all but the most firmly adhered powder from the fabric web and from between the teeth of the chain.

From the rotary brush station 74, the chain is conveyed through a second induction heating unit, generally designated by the numeral 84. Since it is substantially identical to heating unit 58, further description is unnecessary. Suffice to say that the function of the second induction heater 84 is to produce final fusion or curing of the deposited resin, as the case may be, to thereby develop the ultimate qualities of the coating.

Before exiting from the system, the zipper chain 16 passes over a blower head 88, from which air (supplied by means not shown) is discharged into contact with its opposite faces. The purpose of the air is to cool and harden the heated resin, so as to ensure that the coating is not damaged in any way during movement through the drive assembly 22 or in the collection means (which is not shown, but which may simply be a box into which the chain is deposited).

In FIGS. 4 and 5 the structure of a typical zipper chain 16 is depicted. Of particular note is FIG. 5, wherein the coating produced using the system of the invention is shown to be uniform and continuous on the surface of the teeth 86. Most notably, it can be seen that the coating 90 extends over substantially all surfaces of the teeth 86, including those which lie on the inner, normally obstructed portions thereof (i.e., between the teeth), and that the fabric web 92 is free of deposits. (It will be noted that, for numbering purposes, the presence of the coating is ignored in FIG. 4.)

Although the drawings illustrate the preferred system, it will be appreciated that modifications can be made within the concepts of the invention. For example, other electrostatic coating means may be employed in which the powder is presented to the zipper chain in a less controlled manner, such as by simply conveying it through the cloud of charged particles generated over an electrostatic fluidized bed, or by using electrostatic powder spray guns. However, any such reduction in control of powder will tend to reduce commensurately the reliability of the system for the production of good quality coatings, and will increase the need for powder recovery capacity; it will also require more attention to removal of particles deposited upon the fabric of the chain.

Moreover, airborne techniques will generally be less desirable because of the inherent propensity of the airstream to dislodge deposited particles. One of the most notable aspects of the invention relates, as has been indicated hereinbefore, to the high level of coating integrity that is obtained over all exposed surfaces of the teeth of the zipper, including those interior surfaces which lie between the teeth. This is believed to be due to the ability of the charged particles to search-out and deposit upon uncoated grounded surfaces, in preference to those surfaces which have already been covered. Again, the close proximity that is achieved using the preferred mechanical powder delivery apparatus is believed to enhance that effect. Because of the tendency for air channeling to occur between the teeth, the airborne techniques may cause some particle dislodgement and, to that extent, to be counterproductive, depending of course upon the force of the airstream. Presenting the particles to the chain as a relatively still air suspension (such as can be accomplished with a suitably hooded fluidized bed) will therefore usually be preferable to the use of air guns. In any event, it will be advantageous for the electrostatic coating means on the two sides of the travel path to be independently controllable, so as to permit dissimilar amounts of the powder to be provided; this may be desirable to compensate for the slight difference in the configuration of the teeth on the opposite sides of the chain.

The powder used to produce the coating will normally be a synthetic resin, of either the thermoplastic or thermosetting type. The choice will depend upon the properties that are to be produced, and will be evident to those skilled in the art. For example, depending upon whether the deposit is to afford gloss, color change, protection against corrosion or deterioration (such as from washing solvents), dyeability, lubricity, or a combination of those or other qualities, the powder used may be a polyolefin, a halogenated polyolefin, a nylon, an epoxy or a polyester, etc.

The results of heating will depend upon the powder employed, at least insofar as the mechanisms of cohesion and fusion are concerned. Specifically, when the powder is a thermoplastic resin the first heater will produce initial bonding and fusion, with the second producing reflowing of the resin for smoothness, gloss, and the like. In the case of thermosetting resins, on the other hand, while the ultimate effects will be the same, they will be produced through resin curing mechanisms, rather than by reflow.

Use of induction heating is a significant feature of the invention, because it readily provides the necessary means by which heating in limited areas can be effected. Because an induction technique produces "skin" heating rather than a more pervasive effect, the main body of each tooth remains relatively cool and available as a heat sink. Consequently, after passing through the induction heater the zipper chain is "mass quenched" by its teeth, thereby further protecting the fabric web against the deleterious effects of heat. As a specific example, whereas it may be desirable to heat the deposited powder to a temperature of 450° to 500° Fahrenheit, the web may not be able to withstand temperatures in excess of about 350° (such as when it is made of a polyester). By concentrating the effect in such a way as to avoid both direct heating of the fabric and also indirect heating by conduction from the teeth, the present invention accommodates chains having such a typical construction.

Although not illustrated, it should be understood that the present system and method may be employed to coat the zipper chain in open (i.e., "unzipped") as well as closed position. Modifications will of course be made to the equipment for that purpose, such as to adapt the conveying, coating, heating and cleaning stations to accommodate the slight differences that would be involved. While still of outstanding benefit, the advantages of coating in the open condition are somewhat less pronounced, and the operations are somewhat less convenient; therefore, the illustrated technique is preferred. In any event, coating is carried out on a continuous basis, which affords a production capability not believed to be possible heretofore. Finally, although not illustrated, the coating wheels and the chain conveying wheels may be driven by the same, variable speed, motor, so as to facilitate modification of production rates without loss of necessary synchronization.

Thus, it can be seen that the present invention provides a novel method and apparatus for continuously coating zipper chain with a heat-fusible particulate coating material. The coating may be produced on chain which includes a web made from a fabric that is deleteriously affected by exposure to elevated temperatures, and it uniformly covers substantially all exposed surfaces of the teeth of the zipper. The method and apparatus are adapted for high speed, efficient, convenient, and relatively inexpensive operation.

Having thus described the invention, what is claimed is:

1. A method of continuously producing smooth, adherent coatings upon the teeth of a zipper chain, comprising the steps of:

a. continuously moving a zipper chain along a travel path, said chain being comprised of a fabric web and a multiplicity of metal teeth affixed thereto;
b. generating a cloud of electrostatically charged particles of a heat fusible powder;
c. depositing said particles upon said moving chain in areas substantially limited to the surfaces of said teeth;
d. heating said moving coated chain only in said limited areas by generating heat within said teeth, to effect fusion and at least initial cohesion of said deposited particles;
e. removing from said moving chain inadequately adhered particles; and
f. reheating said limited areas of said moving chain, to effect final cohesion of said particles and to produce, upon cooling of said chain, a smooth, adherent coating thereof on said teeth.

2. The method of claim 1 wherein said particles are mechanically carried into close proximity to said teeth, and wherein the attractive force of said teeth upon said particles is greater than that of the means for so carrying said particles, whereby said transfer from said carrying means to said teeth is effected electrostatically.

3. The method of claim 2 wherein said carrying means includes a member having a surface configured to maximize the quantity of said powder presented to said teeth and to minimize the quantity thereof presented to said fabric web.

4. The method of claim 1 wherein said heating of said chain is produced by electromagnetic induction so as to substantially limit the heat generated to a surface effect.

5. The method of claim 4 wherein the electromagnetic flux pattern is configured to promote optimal heating of said teeth.

6. The method of claim 5 wherein said reheating effect is produced in the same manner as said initial heating effect.

7. The method of claim 1 wherein said inadequately adhered particles are removed by brushing between said teeth in a direction generally parallel to the longitudinal axes thereof.

8. Apparatus for continuously producing smooth, adherent coatings upon the teeth of a zipper chain, comprising:

a. means for continuously conveying a zipper chain comprised of a fabric web and metal teeth along a travel path;
b. means for generating a cloud of electrostatically charged particles of a heat fusible powder;
c. means for depositing said particles upon said zipper chain as it moves along said travel path, said depositing means including means for carrying said charged particles into proximity to said teeth to deposit powder in areas substantially limited to the surfaces thereof, said deposit being produced by electrostatic attraction of said particles to said teeth surfaces;
d. means for heating said coated chain as it moves along said travel path to effect fusion and cohesion of said deposited particles, said heating means being effective to heat said chain substantially only in said limited areas by generating heat within said teeth;
e. means for removing inadequately adhered particles from said zipper chain as it moves along said travel path; and
f. means for reheating said teeth of said zipper chain as it moves along said travel path to effect final cohesion of said particles and to produce, upon cooling of said chain, a smooth, adherent coating thereon.

9. The apparatus of claim 8 wherein said carrying means mechanically carries said charged particles into close proximity to said teeth.

10. The apparatus of claim 8 wherein said carrying means comprises a pair of rotatable wheels, one of said wheels being disposed on each side of said travel path to effectively present said powder to said chain and to permit simultaneous coating of both sides thereof, said apparatus additionally including electrostatic fluidized bead means, said wheels being disposed to rotate through said fluidized bed means so as to enable deposits of said powder to be produced upon the circumferential edges thereof, the attractive force of said teeth upon said particles being greater than that of said wheels thereupon, whereby said transfer from said wheels to said teeth is effected electrostatically.

11. The apparatus of claim 10 wherein said zipper chain moves horizontally along said travel path with a vertical orientation, and wherein said wheels are disposed at an angle of substantially 45° with respect thereto, said wheels having an edge bevel of substantially 45° to permit close proximity to the surfaces of said zipper chain.

12. The apparatus of claim 10 wherein said wheel edges are grooved to permit partial enclosure of said zipper chain teeth thereby during simultaneous rotation of said wheels and passage of said zipper chain along said travel path, thereby maximizing the amount of powder presented to said teeth and minimizing the amount presented to the web.

13. The apparatus of claim 10 wherein at least the circumferential edges of said wheels are electrically insulated to reduce the attraction of said charged particles thereto.

14. The apparatus of claim 8 wherein said heating means is an electromagnetic induction heater.

15. The apparatus of claim 14 wherein said heater includes elements dimensioned and configured to produce an electromagnetic flux pattern that is configured to promote optimal heating of said teeth.

16. The apparatus of claim 15 wherein said elements comprise a pair of opposing, C-shaped heads within the coil of said heater, said heads being dimensioned and configured to substantially surround said teeth as said chain passes therebetween.

17. The apparatus of claim 14 additionally including a second induction heater located downstream of said first-mentioned heater, said second heater being provided for reheating of said chain.

18. The apparatus of claim 17 wherein said removing means includes a brush operative to brush between said teeth in a direction generally parallel to the longitudinal axes thereof, said brush being disposed between said first-mentioned and said second heaters.

* * * * *